United States Patent [19]

McGowan

[11] 4,374,790

[45] Feb. 22, 1983

[54] METHOD AND APPARATUS FOR PUMPING CONCRETE TO FORM STRUCTURE AT ELEVATED HEIGHTS

[75] Inventor: Joseph L. McGowan, Harpenden, England

[73] Assignee: Marley Company, Mission, Kans.

[21] Appl. No.: 166,988

[22] Filed: Jul. 8, 1980

[51] Int. Cl.³ ..... E04B 11/16; E04G 21/04

[52] U.S. Cl. ..... 264/32; 52/743; 264/33; 264/34; 264/35; 264/310; 264/333; 425/60; 425/63; 425/64

[58] Field of Search ..... 414/10, 786; 52/743; 137/355.24; 294/78 A, 81 R, 81 SF; 264/32, 33, 34, 35, 310, 333; 425/63, 64, 60; 212/242, 199, 200

[56] References Cited

U.S. PATENT DOCUMENTS

| | | | |
|---|---|---|---|
| 2,979,798 | 4/1961 | Price | 264/32 X |
| 3,252,199 | 5/1966 | Bössner | 52/743 X |
| 3,417,429 | 12/1968 | Wright | 264/34 X |
| 3,567,040 | 3/1971 | Thomson | 212/242 |
| 3,619,431 | 11/1971 | Weaver et al. | 264/33 X |
| 3,709,548 | 1/1973 | Hogshead | 294/78 A X |

FOREIGN PATENT DOCUMENTS

| | | | |
|---|---|---|---|
| 2310952 | 3/1973 | Fed. Rep. of Germany . | |
| 2619334 | 11/1977 | Fed. Rep. of Germany . | |
| 1207913 | 9/1959 | France | 294/81 R |
| 1488156 | 5/1967 | France | 294/81 R |
| 679263 | 9/1952 | United Kingdom | 425/63 |
| 1151173 | 5/1969 | United Kingdom . | |
| 1335073 | 10/1973 | United Kingdom . | |

*Primary Examiner*—Leslie J. Paperner

*Attorney, Agent, or Firm*—Schmidt, Johnson, Hovey & Williams

[57] ABSTRACT

A method and apparatus is disclosed for continuously pumping flowable concrete mix to elevated heights for introduction into forms used in the fabrication of annular structures such as concrete hyperbolic cooling towers. A tower crane is erected in the center of the circle for the hyperbolic structure and concrete conveying piping is provided for raising mix to a lateral conduit carried by a secondary boom suspended from the swingable overhead jib of the crane. A pumping unit at ground level forces concrete mix up the vertical piping on the tower and then through the boom supported conduit for delivery into the form structure. The jib and thereby the boom suspended therefrom are swingable through an arc of 180° in one direction to cover one half of the form structure and then the jib and boom may be swung in the opposite direction through the remaining 180° arc for introduction of mix into the form structure. The tower crane is of the type having a climbing cage permitting lifting of additional mast units to the top of the stack thereof using the jib as a lifting medium to increase the height of the crane. Corresponding pipe sections on the tower mast units allow delivery of concrete mix to increasingly higher elevations as fabrication of the hyperbolic structure progresses. The length of the secondary boom and thereby the laterally extending conduit supported thereby may be increased or decreased as necessary to accommodate the changing diameter of the hyperbolic concrete shell during construction.

9 Claims, 8 Drawing Figures

METHOD AND APPARATUS FOR PUMPING CONCRETE TO FORM STRUCTURE AT ELEVATED HEIGHTS

BACKGROUND OF THE INVENTION

1. Field of the Invention

This invention relates to method and apparatus for pumping concrete to elevated heights and is especially useful for continuously lifting flowable concrete mix to forms used in the fabrication of annular structures such as concrete hyperbolic cooling towers.

In the construction of annular structures in the nature of hyperbolic cooling towers, upright base support pillars are first erected in position defining an inlet for air which is drawn upwardly through the final tower by natural convective draft. The concrete shell which rests on these supports is fabricated by erecting forms which are sequentially filled to present annular rings concentric with the center of the tower. After adequate curing of a respective ring, the forms are raised through an increment to define the next annular segment of the tower. By virtue of the changing diameter of the hyperbolic tower during its fabrication, the forms are of such nature that the circumferential extent thereof may be increased or decreased as necessary to comform to the hyperbolic design.

Since each of the annular concrete rings is allowed to set up and harden before the next annulus is formed, the shell itself may be used as a foundation for lifting the forms to the next higher elevation for fabrication of a succeeding ring. Generally speaking, appropriate scaffolding is provided in association with the forms so that workmen may implace reinforcing rod and control the introduction of concrete mix into the form cavity.

2. Description of the Prior Art

Heretofore, it has been conventional practice to station a tower crane at the center of the shell to be constructed with the rotatable jib at the top of the crane being rotatable through a 360° arc. A winch line controlled from the cab of the tower crane may be lowered to the ground to pick up a concrete mix bucket which usually holds about two cubic yards of concrete. After the bucket is filled at the mix plant, it is raised by the winch line to the level of the circumferentially extending forms and the jib rotated through an arc at the same time that the bucket is moved to a lateral position overlying the forms so that the workmen may direct the concrete into the area of the forms next to be filled. This batch operation is continued until the entire perimeter of the forms have been filled with concrete mix. The bucket is then either run out toward the end of the jib or brought back toward the tower mast and lowered to the mix plant accompanied by the necessary rotation of the jib so that a fresh batch of the mix may be loaded into the bucket. Each time the bucket is lifted, it is swung to a position for deposit of material in the next adjacent area of the cavity to be filled.

A typical concrete hyperbolic cooling tower is, for example, about 450 feet high, has a diameter of 330 feet at ground level, 300 feet at the commencement of the concrete shell, 163 feet wide at the throat and 180 feet in diameter at the top. Generally as much as 600 cubic yards of concrete must be hoisted to the form level during each 8 hour working day for the thicker parts of the shell, and at least 150–160 cubic yards per day during fabrication of the throat part of the tower. Generally speaking, the forms are lifted about 6 feet per day with each pour being allowed to cure to a required degree, and then the forms shifted upwardly to their next incremental position. The circumference of these climbing forms is adjusted as necessary to define the required hyperbolic shape. Since circumferential as well as upright reinforcing bars are provided in the form cavity, as well as the transverse bars which serve as supports for the forms, one of the challenges that must be overcome in use of the tower crane-batch bucket elevation of concrete to the construction site is the maneuvering of that bucket around the re-bars while at the same time swinging the bucket as necessary to effect even deposit of the mix between the forms. One other inherent disadvantage of the bucket method of raising concrete to the construction level is the time consumed in lowering the bucket back down to ground level and then returning the same to the location where the next area is to be filled. Even the use of more than one bucket so that one can be filled while another is being unloaded does not save a great deal of time, by virtue of the fact that much time is lost in attempting to properly position and maneuver the bucket as concrete is discharged through the bottom gate thereof.

SUMMARY OF THE INVENTION

It is the primary object of the present invention to provide an improved method and apparatus for lifting concrete mix to form structure at elevated heights in a manner that allows continuous delivery of concrete to the forms while affording precise control over the introduction of the mix into the form cavity as well as along the length of the forms.

Another very important object of the invention is to provide a method and apparatus for continuously pumping flowable concrete mix to elevated heights for introduction into forms of the type used in the fabrication of annular structures such as concrete hyperbolic cooling towers, wherein pouring of mix into the annular form structure defining the next area of the tower to be formed may be carried out on substantially a continuous or non-continuous basis as desired and at a selectively controllable flow rate.

An especially important object of the invention is to provide a method and apparatus as described which advantageously makes use of a conventional tower crane heretofore used in fabricating large concrete structures including hyperbolic cooling towers, but which is modified in a manner to allow flowable concrete mix to be directed to forms for example at an elevated height defining the annular section next to be poured of a tower, and wherein pumping of mix at the beginning of a construction shift may readily be initiated, while at the same time allowing dismantling of the pumping apparatus at the end of the day for cleaning purposes with a minimum of time and effort being involved.

A still further object of the invention is to provide a method and apparatus for continuously pumping flowable concrete mix to elevated heights wherein upright piping means coupled to a concrete pumping unit, is joined at the upper end thereof to a laterally extending conduit carried by a secondary boom suspended from the rotatable jib of a tower crane in such manner that the conduit means can be positioned to direct the concrete mix into the form structure as the jib and thereby the boom carried thereby is rotated about the vertical axis of the tower mast. In this manner, concrete mix may be continuously directed into the form structure throughout a significant annular extent thereof while close control is maintained over the rate of delivery of the concrete as well as the specific point of placement thereof.

Also an object of the invention is a method and apparatus as referenced above wherein the use of a tower crane for supporting the concrete mix conveying means allows the point of delivery of the concrete to be raised as necessary to adjust for the increasing height of the structure being poured, without attendant delays in supply of the concrete mix and utilizing a minimum of man hours time.

Also an object of the invention is to provide a method and apparatus for continuously pumping flowable concrete mix to elevated heights especially adapted for use in fabrication of hyperbolic cooling towers wherein the secondary boom suspended from the tower crane jib and carrying the laterally extending mix conveying conduit means thereon may be readily adjusted in effective length to provide compensation for the decreasing or increasing effective diameter of the hyperbolic shell being constructed.

Other important objects and details of the invention will become obvious or be described in greater detail as the following description progresses.

DESCRIPTION OF THE PREFERRED EMBODIMENT

Figure 1:
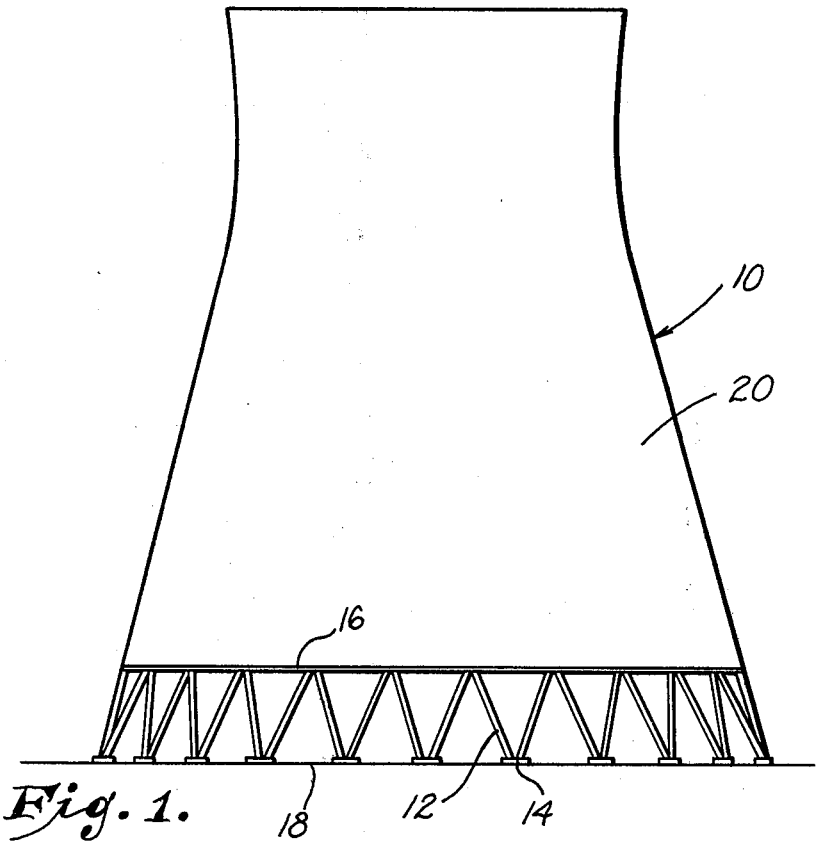
FIG. 1 is a side elevational view on a reduced scale of one type of counterflow hyperbolic concrete cooling tower which may be more efficiently constructed than in the past by virtue of the fact that the method and apparatus of this invention provides a way to efficiently deliver concrete mix to the form structure for the tower as the latter is being fabricated.

As previously indicated, the apparatus of this invention is particularly useful for carrying out a method of continuously pumping flowable concrete mix to elevated heights for pouring of concrete structures such as the counterflow type hyperbolic cooling tower broadly designated 10 in the drawings. The inclined concrete support columns 12 at the base of the tower are carried by plinths 14 and merge at an annulus 16 spaced vertically above the concrete, ground level water collection basin 18 so that air may enter tower 10 around the entire perimeter of the base thereof. The concrete shell 20 extending upwardly from the annulus 16, is constructed by pouring a successive series of annular sections which are reinforced with upright, transversally extending, and circumferentially disposed steel rods. Typical dimensions of a cooling tower of the type illustrated in FIG. 1 have previously been recited but it is also to be recognized in this respect that the thickness of the shell 10 may vary as the height increases. Furthermore, as is clearly evident from the schematic showing of FIG. 1, form structure for pouring the annular ring segments of shell 20 must be of such nature as to provide for incremental change in the diameter of the rings being poured, first decreasing as the height of the tower increases, and then again becoming larger after the minimum diameter of the throat of the tower has been poured.

Figure 2:
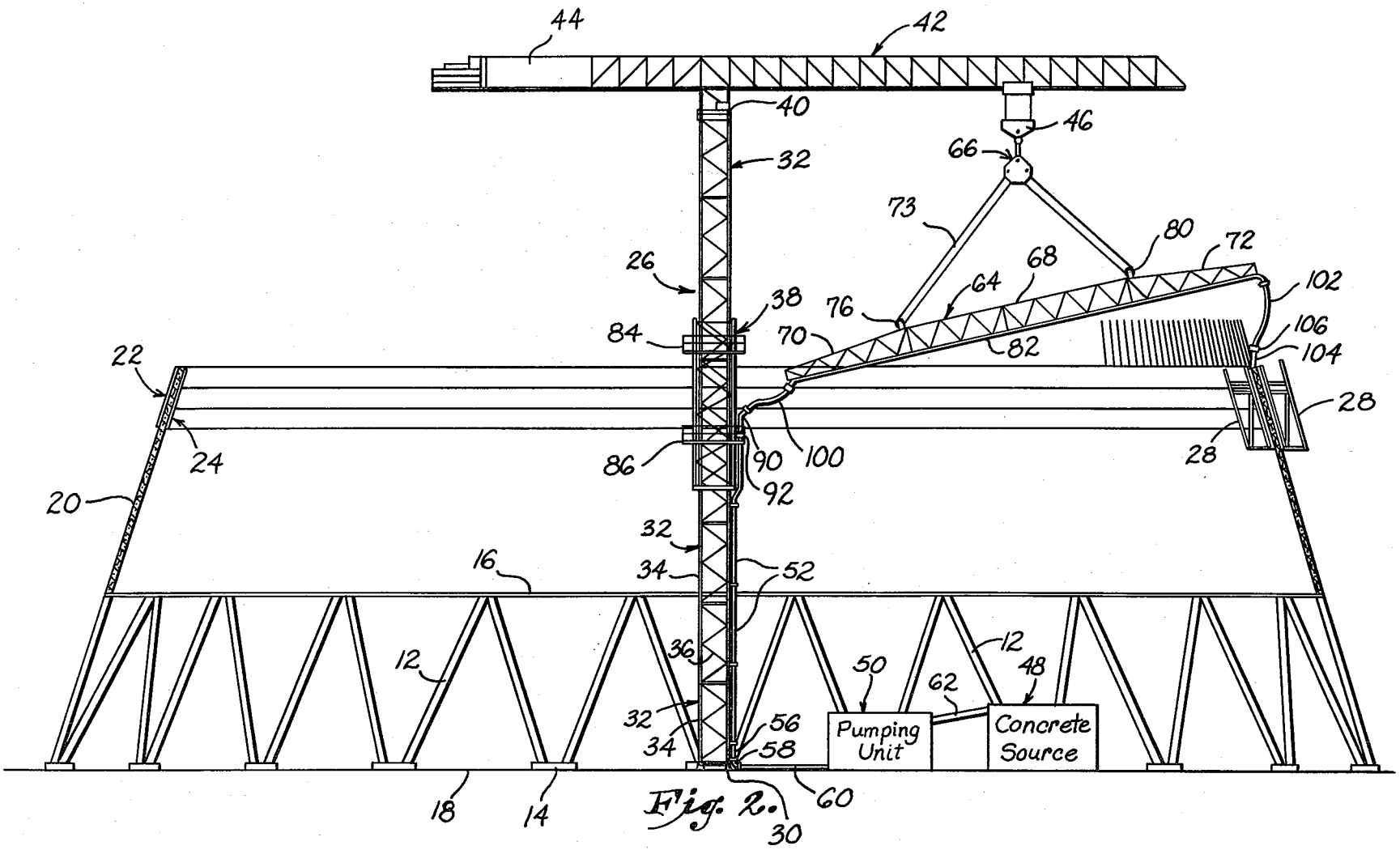
FIG. 2 is a schematic, essentially vertical cross-sectional view through a hyperbolic cooling tower under construction and illustrating the novel apparatus for delivering concrete mix on substantially a continuous basis to annular form structure defining the ring portion next to be poured of the tower.

As best seen in FIG. 2 for example, opposed forms 22 and 24 preferably of the climbing type, present an annular space therebetween which is of greater diameter at the base of the forms than at the upper extremity thereof to allow formation of the inclined side walls of the shell 20. Generally speaking, workman supporting scaffolding 28 is associated with the inner and outer forms 22 and 24 respectively to allow workmen to raise the forms as desired, as well as mount reinforcing bar in place and control delivery of concrete mix into the cavity defined by forms 22 and 24. It is to be appreciated in this respect that the forms 22 and 24 are actually made up of a large number of rectangular sections of greater height than width, and suitably joined together by fastening means at the budding edges thereof. Forms of different widths are also provided so that as the forms generally designated by the numerals 22 and 24 are raised, the effective diameter of the cavity presented thereby may be decreased or increased as necessary to provide the required hyperbolic shape of the concrete structure being formed. In addition, transverse steel rods are provided in the space between opposed forms 22 and 24 which project through the forms to act as support means for the latter and allow the same to be successively raised a required distance for pouring of individual concrete rings making up the shell 20 of tower 10.

Still referring in specific detail to FIG. 2, a tower crane broadly designated 26 is mounted in the central area of the tower being constructed and is of the type having suitable mast pads 30 or the like at ground level which support a series of vertically stacked box frame type mast sections or units 32 having four upright corner posts 34, each joined and interconnected by a series of cross braces 36 presenting a trellis type construction. The mast sections 32 are stackable one on top of the other to raise the effective elevation of crane 26 as the height of shell 20 increases.

Tower crane 26 also is preferably provided with a climbing cage 38 which is supported by the mast sections 32 and may be raised or lowered as desired relative to the longitudinal length of the tower mast. The primary purpose of climbing cage 38 is to permit additional mast sections to be placed in the vertical stack thereof at the top to increase the height of the crane.

A turntable 40 on the uppermost mast section 32 rotatably supports a jib 42 having a counterbalance 44 at one end thereof and shiftably supporting a hoist 46 movable along the under side of the box frame jib 42. Upon raising the climbing cage 38 to the top of the stack of mast units, it may then be further raised to move jib 42 to a height where an additional mast section 32 may be raised with the hoist 46 to a position for insertion in the cavity of the climbing cage. In this manner, the height of tower crane 26 may be selectively increased in a step wise fashion.

The improved apparatus hereof further includes a source of pumpable concrete mix, which for example may be a portable mix plant or the like adjacent the construction site, or mix may be prepared at a remote site and conveyed to a holding vessel adjacent tower crane 26. For purposes of this description, it is understood that these multiple sources of flowable concrete mix are equivalent, and for that reason, the source of concrete has been shown schematically in the drawings and designated generally by the numeral 48.

A trailer mounted concrete pump may also be provided in association with the source of concrete 48 and preferably may comprise an oil-hydraulic concrete pump assembly of the type known for low maintenance and high reliability. Exemplary units in this regard include those manufactured by American Pecco Corporation of Millwood, N.Y. and sold under the model designations of BRA 1407-09 inclusive. Pumping units of this type are capable of conveying concrete mix to heights in excess of 450 feet and horizontal distances of the order of 2000 feet using 5 inch conveying lines. Other equivalent pumping units may be employed though, and for this reason the pumping unit has again been shown schematically in the drawings and designated by the numeral 50. It is to be preferred that the pumping unit be of such nature that the concrete output therefrom is infinitely variable within a selected range, for example from 0 to 125 yards per hour in direct proportion to the speed of pump prime mover. Each of the mast sections 32 is provided with a length of concrete mix conveying pipe 52 thereon, preferably located at one of the corner posts 34 of a respective mast section. Once the lowermost mast section 32 has been placed on the pads 30 therefor, an upright adaptor pipe 56, elbow 58 and a length of pipe 60 may be used to join pumping unit 50 to the lowermost pipe section 52. Similarly, pipe or chute means 62 may be provided for conveying concrete mix from source 48 to a hopper on pumping unit 50 while provide a suitable head on the suction of the pump.

Each of the pipe sections 52 is joined end to end as mast sections 32 are stacked one on top of the other so as to provide a continuous flow path for the concrete mix. Although various sizes of pipes may be used, a 5 inch internal diameter pipe is preferred for most applications.

A secondary boom broadly designated 64 referencing FIG. 2 is suspended from the rotatable jib 42 through the medium of primary hoist 46, as well as a modified chain hoist 66. As depicted in FIG. 2, boom 64 has a central open frame section 68 of uniform cross section, along with two end, longitudinally tapered, open frame terminal sections 70 and 72. The sections 70 and 72 are preferably disposed such that the lower margins thereof are coplanar with the bottom segment of the central boom section 68. As previously indicated, the secondary boom 64 is suspended from jib 42 by means including an elongated chain 73 connected to and having a stretch trained through the chain hoist 66. As shown schematically in FIGS. 2, 3 and 4, the left end of chain 73 is secured to the housing 74 of hoist 66. The chain then extends downwardly and is received over a rotatable sprocket 76 on the lefthand end of central boom section 68, then returns to the hoist 66, is trained over a drive sprocket 78 shown schematically in FIG. 4, thence has a downward stretch trained over another sprocket 80 carried by the end of boom section 68 opposite sprocket 76, and finally extends back to the housing 74 of hoist 66 and is secured to the latter. In this manner, it can be seen that upon rotation of the drive sprocket 78 in either a clockwise or counterclockwise direction as controlled by the operator, the secondary boom 64 will be tilted in a vertical plane to change the longitudinal orientation thereof with respect to the horizontal.

In an alternate embodiment of the support structure for secondary boom 64, an electric drive may be provided on the end boom section 70 for driving the chain 73 in lieu of a motor forming a part of hoist 66. This construction allows for shorter electric leads for the drive motor which can be permanently affixed to boom section 70. In addition, a flexible cable may be used instead of a chain.

Figures 3, 4:
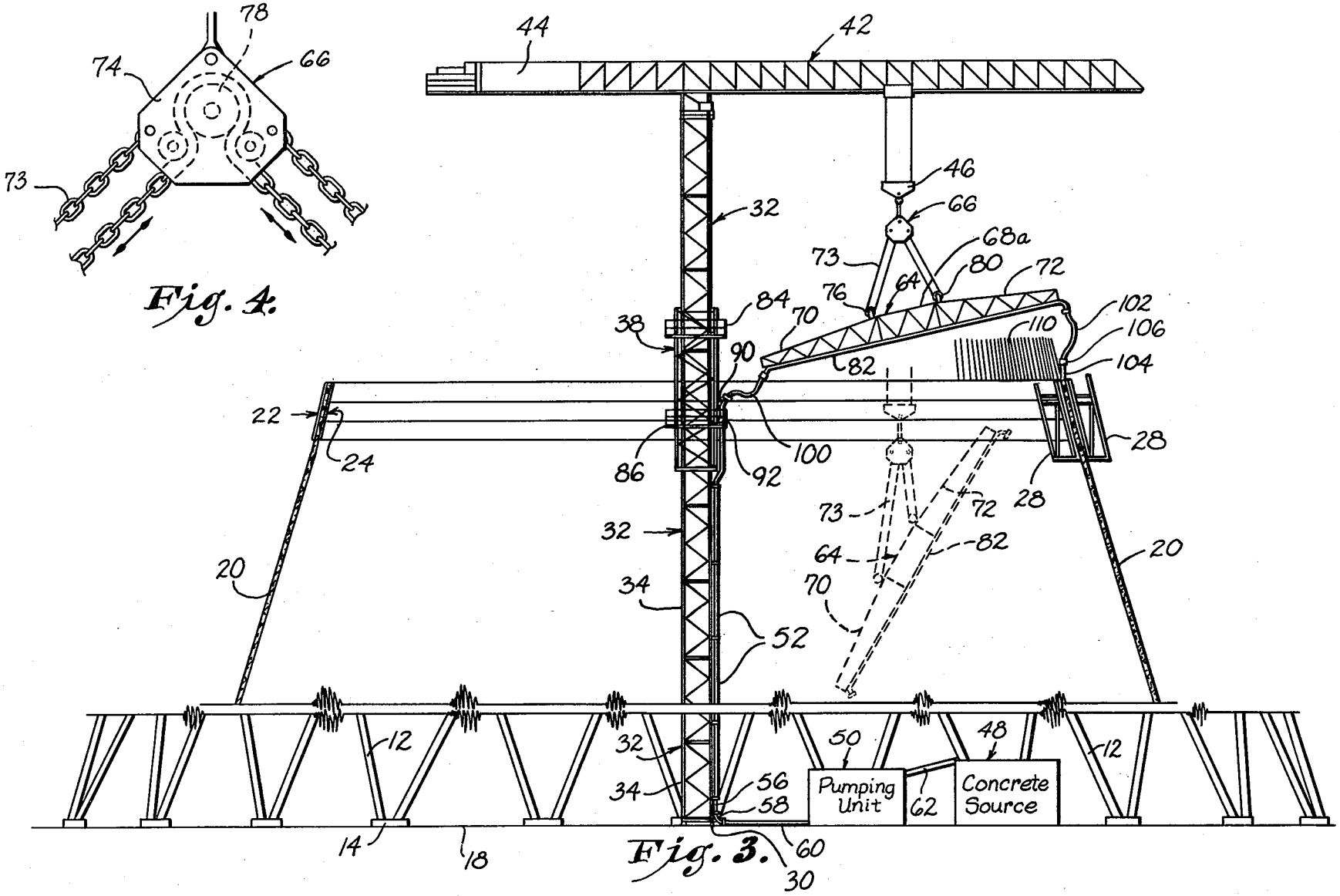
FIG. 3 is a schematic, essentially vertical cross-sectional view similar to FIG. 2, and illustrating the apparatus of this invention in the configuration thereof used to pour an upper part of the tower shell as depicted in FIG. 1 of the drawing.
FIG. 4 is a fragmentary, generally schematic representation of the chain hoist used to support the secondary boom suspended from the jib of the tower crane so that the angularity of the concrete conveying support boom may be adjusted at will relative to the horizontal for control over delivery of concrete mix to the form structure, or for raising and lowering the boom as indicated by the dotted lines of FIG. 3.

A concrete mix conveying conduit 82 is carried by the underside of secondary boom 64 and although depicted schematically as a continuous stretch of conduit in FIGS. 2 and 3, it is to be appreciated that the conduit may in fact be made up of a number of interconnected pipe segments.

It is also to be seen from FIGS. 2 and 3 that the climbing cage 38 conventionally has upper and lower workman catwalks 84 and 86 thereon and the lower catwalk provides a convenient way for workmen to have access to the ends of pipe sections 52 for intercoupling of the same as mast sections 32 are added to the tower crane. In addition, climbing cage 86 has a pipe joggle section 88 thereon having a jog **88*a* in the lower extremity thereof to accommodate the fact that the climbing cage 38 is of greater transverse dimensions than the associated mast sections 32 received therewithin. A pipe unit 90 comprising in effect a 45° elbow is connected to the upper end of pipe section 88 through a rotary coupling 92. Support structures 94 and 96 respectively carry pipe unit 90 on the associated upright's main frame corner member 98 of climbing cage 38 for swiveling motion through an arc of at least about 270° about the axis of the upright stretch of pipe unit 90 (See FIG. 7). The uppermost end of the swivel pipe unit 90 is joined to conduit 82 on secondary boom 64 by a flexible hose 100**.

Another flexible hose 102 joined to the downturned end of the outermost extremity of conduit 82 has a velocity reducing, elongated spout 104 joined to the discharge end of hose 102 by a rotary coupling 106. Assuming hose 102 to also be of 5 inch tubing, the top end of the velocity reducing spout 104 is of 5 inch diameter with the lower extremity thereof initially being about 10 inches in diameter to define a truncated cone, and with the bottom of such cone being deformed so that the effective transverse width remains 5 inches, while the elongated dimension is of the order of 13 inches. In this manner, concrete mix 108 may be directed into the space between forms 22 and 24 around reinforcing bars 110. Although not depicted in detail, it is to be understood that a mix discharge control gate may be provided at the lower end of the spout 104.

In the operation of the apparatus for elevating concrete mix to the level of forms 22 and 24, pumping unit 50 is selectively actuated to cause flowable concrete mix to flow through pipe 60, elbow 58, adapter pipe section 56, respective pipes 52, joggle pipe 88, swivel pipe unit 90, flexible hose 100, conduit 82, flexible hose 102, and finally then discharged into the space between forms 22 and 24 through the velocity reducing transition spout 104. Workmen stationed on the scaffolding 28 may precisely control the delivery point of the concrete mix and move the spout 104 as necessary to assure introduction of the mix into the proper location between forms 22 and 24. Furthermore, the jib 42 may be rotated as necessary to swing the secondary boom 64 and thereby the conduit 82, flexible hose 102 and transition spout 104 as through a required arc to introduce concrete mix into the annular defining form structure on substantially a continuous basis.

Figure 5:
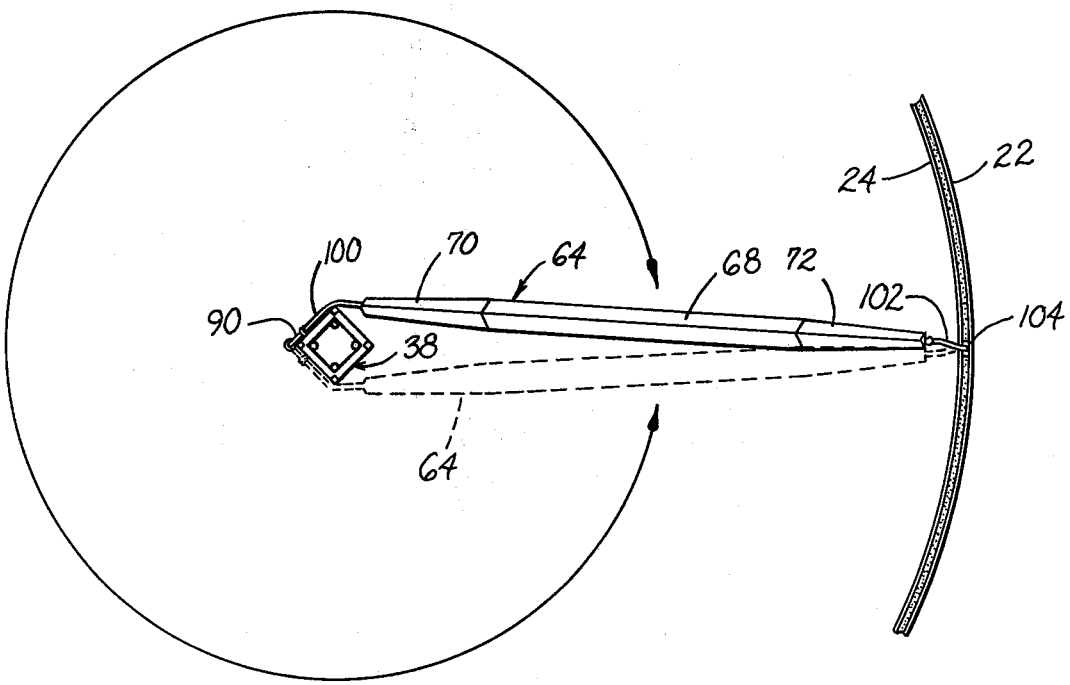
FIG. 5 is a fragmentary, generally schematic representation in plan view of the apparatus of the invention and showing the way in which the support boom for the laterally extending concrete conveying means may be swung through opposite 180° arcs to allow mix to be delivered into the entire circumference of the annular ring defining form structure used in fabricating the hyperbolic cooling tower.
Figure 7:
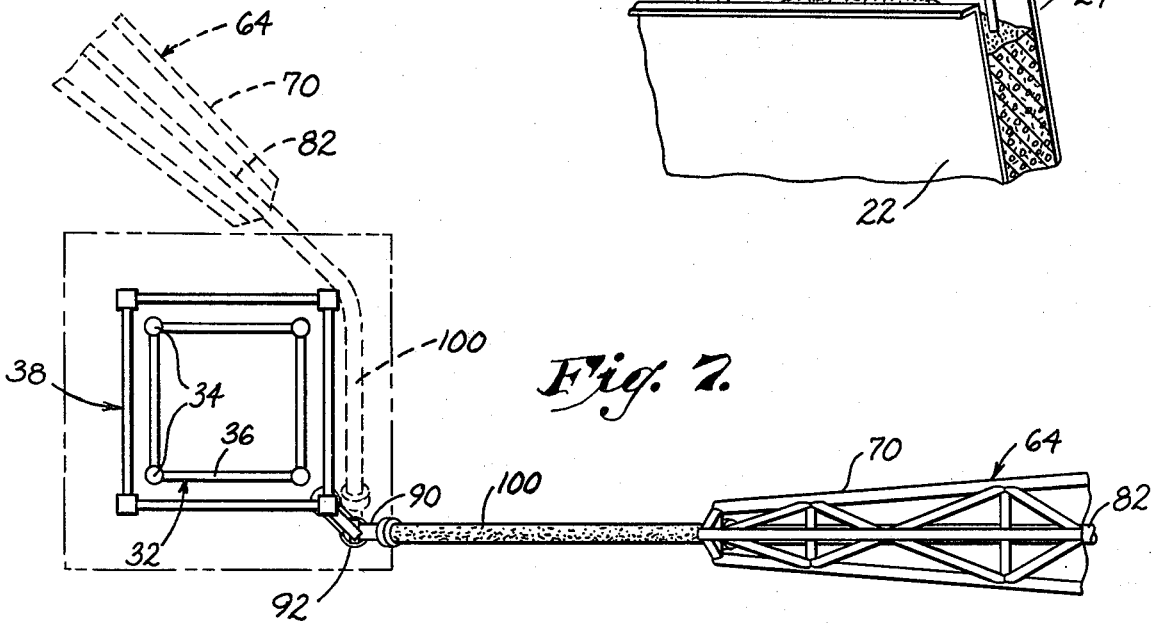
FIG. 7 is also a schematic representation of the structure illustrated in FIG. 6, but looking downwardly thereon to more specifically show the way in which the flexible hose and rotary coupling between the upright piping and the laterally expending mix conduit allow the latter to be swung through an arc about the axis of the tower mast without interruption in flow of the concrete mix.

As is most evident from FIGS. 5 and 7, the swivel adapter pipe unit 90 and the flexible hose 100 allow the secondary boom 64 to be rotated through opposite arcs of essentially 180° to permit the entire circumference of the annular space between the form structures 22 and 24 to be filled with concrete. This 180° swinging motion of the boom structure 64 and thereby the associated concrete conveying conduit means thereon is possible in part by swinging movement of the swivel pipe unit 90, and to bending of the flexible hose 100 as shown in full lines as well as dashed lines of the schematic representation of FIG. 5.

It is to be observed from FIG. 2 for example, that secondary boom 64 is depicted as being in inclined disposition with the outer extremity thereof somewhat higher above the ground than the inner end joined to pipe sections 52. This inclined disposition is preferred so that concrete pumped through the conduit means 82 always fills such conduit and there is no tendancy for air to get into the pipe which would interrupt the smooth flow thereof. Furthermore, the inclination of such boom may be changed as desired for most effective pumping without an undue head being imposed on pumping unit 50. In addition, the inclination of the secondary boom 64 at a selected angle allows the hose 102 and associated velocity reducing spout 104 to be maneuvered relative to reinforcing bars 110 extending from the top of the forms 22 and 24 for efficient mix implacement without interruption in the continuity of flow of the concrete.

Directing attention to FIG. 3, it can be seen that the terminal ends 70 and 72 of the secondary boom 64 are the same length as illustrated in FIG. 2, but the effective length of the intermediate boom section **68*a* of shorter length than the corresponding section 68 of FIG. 2. For simplicity, sections 68 and 68*a* have been depicted as a boom member of different effective lengths. In actual practice, it is preferred to employ two terminal end sections 70 and 72 approximately 40 feet in length and to have three intermediate boom sections at 40 feet, 20 feet and 10 feet respectively which may be used together or in any desired combination depending on the diameter of the shell being constructed, or the span needed at that particular elevation of the job. In addition, means is provided on the outer ends of permanent boom sections 70 and 72 to vary the length of the conduits 82** in 2 foot increments.

It can be appreciated that the different intermediate sections 68 are used as the effective diameter of the shell 20 changes to assure that the flexible hose 102 and associated transition spout 104 are spaced a distance from the axis of the mast of tower crane 26 to cause most effective delivery of concrete into the forms 22 and 24.

Figure 6:
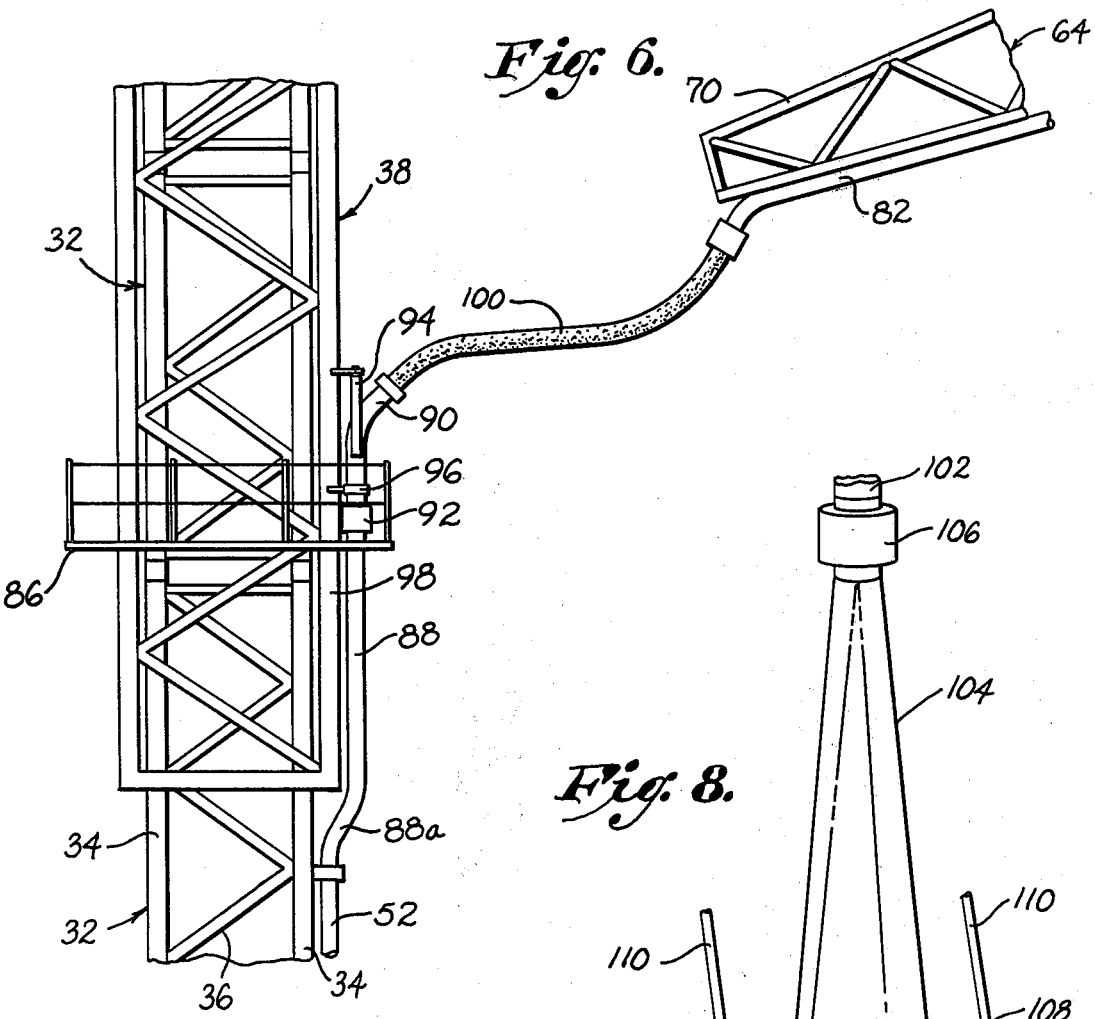
FIG. 6 is a fragmentary, schematic elevational view of a part of the crane tower mast illustrating a segment of the climbing cage forming a part thereof, piping means carried by the mast, one end of the boom supporting laterally extending concrete mix conveying means, and flexible hose and rotary coupling means for allowing concrete to be continuously directed to the perimeter of the tower shell while the support boom is swung about the verticle axis of the tower mast.
Figure 8:
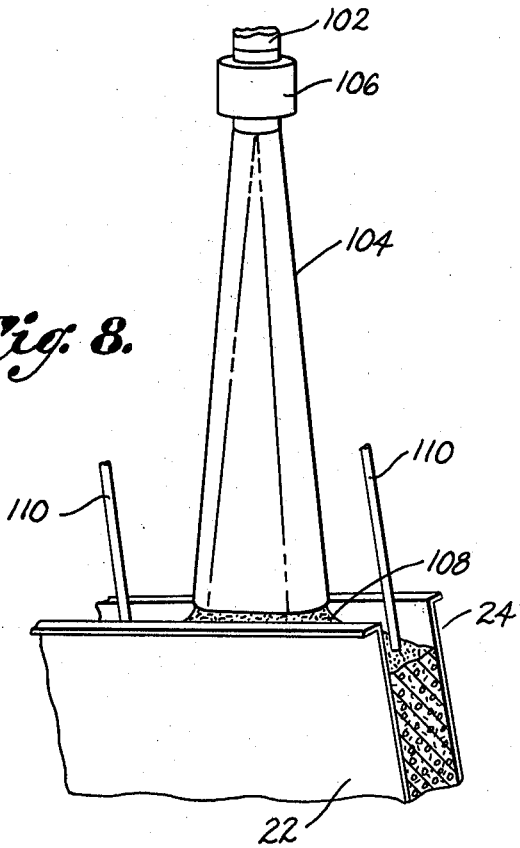
FIG. 8 is a fragmentary, schematic showing of the velocity reducing spout on the end of the concrete mix conveying conduit to allow controlled direction of concrete into the form structure during continuous flow of the mix.

In this connection and again viewing FIG. 3, it can be seen from the dashed line depiction of such drawing that the modified chain hoist 66 may be operated to significantly increase the angle of inclination of the secondary boom to allow the same to be lowered to the ground through the interior space of the shell 20. Raising and lowering of the secondary boom 64 is under the control of the operator of tower crane 26 who may selectively operate the primary hoist 46. When the secondary boom 64 has been lowered to the ground, the effective length thereof may be changed if desired. Also, as is most evident from FIGS. 3 and 6, a workman on catwalk 86 of climbing cage 38 may disconnect the flexible hose 100 from swivel pipe unit 90 to allow lowering of the secondary boom section 64 with the conduit 82 thereon.

Upon disconnection of the conduit 82 from the pipe sections 52, the secondary boom 64 may be lowered to the ground for cleaning of the conduit thereon, and surplus concrete may be sucked back down the vertical extent of pipe sections 52. A water line may also be provided on the mast section 32 of the crane for washing out the vertical pipe sections 52.

The addition of mast sections to tower crane 26 during construction of tower 10 is a function of the effective height of each mast section 32 and the distance the forms 22 and 24 are raised for each pouring. Generally speaking, three or four mast sections 32 will be added each time the height of the tower crane is effectively increased. As a consequence, three pours or more will be made before additional tower mast sections are added. Since the outer end of secondary boom 64 may be raised as desired by simply operating the chain hoist 66, the effective height of the outermost end of secondary boom 64 may be increased as necessary for the second and third pours without the necessity of adding an additional mast section to the tower crane.

The operator of the hose at the end of the secondary boom will be in radio contact with the tower operator at the top of the crane as well as the pump operator at the bottom of the crane so that if necessary the flow can be controlled or stopped as required.

The tower crane and secondary boom assembly of this invention may also be used for purposes other than pumping of concrete to elevated heights during construction of the shell 10. For example, if it is desired to lift an elongated member of a length such that it cannot readily be raised by the jib 42 of the crane 26 through the space between the mast sections 32 and the form structure 22 and 24, such member may be attached to the underside of secondary boom 64 with the longitudinal axis of the item to be lifted parallel with the longitudinal length of the boom sections. The secondary boom may then be raised in a tilted disposition as depicted in FIG. 3 until the item to be lifted has been raised to a structure clearing elevation, whereupon the hoist 66 (or motor drive for sprocket or sheave 76) can be operated as required to position the load to a desired more horizontal location and the jib rotated to bring the item to a selected location.

An especially important feature is the way in which the angularity of the load, or balancing of the load may be accomplished by simply changing the angle of the secondary boom 64 under the control of the hoist 66 or motor drive for sprocket 76. The ability to do so from the operator seat at the top of the tower crane is an advantage in this respect.

Having thus described the invention, what is claimed as new and desired to be secured by Letters Patent is:

1. Apparatus for lifting flowable concrete mix to an elevated height for introduction into a form system defining an annular structure comprising:

crane means including a non-rotatable ground supported, upright tower made up of a number of stackable units mounted one on top of the other;

an elongated jib rotatably carried by the tower adjacent the upper extremity thereof and swingable about the vertical axis of the tower;

an elongated boom;

adjustable suspension means between the boom and the jib supporting the boom in underlying relationship to said jib and operable to permit selective adjustment of the vertical angularity of the boom with respect to the jib while allowing variation of the horizontal angularity of the boom with respect to the longitudinal axis of the jib as well;

concrete pumping mechanism substantially at ground level;

piping means joined to the pumping mechanism, supported by and extending upwardly along the tower depending upon the number of units making up the same to a level approaching that of the boom;

conduit means on the boom, fully supported by the latter, extending along at least a part of the length thereof and having an inboard end adjacent the tower and an outboard end at the opposite extremity of the same;

elongated flexible conduit structure coupled at opposite ends thereof to the inboard end of the conduit means and the upper end of the piping means respectively and constructed and arranged to allow vertical as well as some horizontal movement of the inboard end of the conduit means with respect to the piping means during rotational movement of the boom about the axis of the tower as the conduit structure flexes; and concrete placement means joined to the outboard end of the conduit means for facilitating selective introduction of concrete into said forms as the concrete is pumped thereto by said mechanism via the piping means, said flexible conduit structure, the conduit means and said concrete placement means, said jib being rotatable in either direction to an extent allowing movement of the boom through opposite arcs such that the concrete placement means may be maneuvered to permit introduction of concrete mix into the entire 360° circumferential extent of the form system making up said annular structure, said flexible conduit structure being of a length and sufficiently flexible to allow the inboard end of the conduit means to be swung vertically as necessary to maintain a required vertical angularity of the boom and thereby the conduit means after the outboard end of the conduit means has been positioned at a desired variable level for placement of concrete in said form system through said placement means and to accommodate changes in the horizontal angularity of the boom and thereby the conduit means with respect to the longitudinal axis of the jib as the latter and thereby the boom are swung about the tower in opposite directions through arcs allowing the concrete placement means to be positioned in concrete mix directing relationship to the full circumferential extent of the annular forms.

2. Apparatus as set forth in claim 1 wherein said tower is extensible by addition of units to the stack thereof, said piping means having a number of end-to-end pipes of a length allowing additional pipes to be incorporated in the longitudinal length of the piping means to allow accommodation for an increase in effective height of the tower.

3. Apparatus as set forth in claim 1 wherein the boom and thereby the conduit means thereon are of extensible length to allow concrete mix to be directed to said form system at different lateral distances from the axis of the tower without changing the support location of the tower crane on the ground.

4. Apparatus as set forth in claim 1 wherein is provided a series of transversely rectangular, elongated units stackable in self-supporting relationship and the pipe means extends upwardly along the tower essentially along one of the corners thereof.

5. Apparatus as set forth in claim 1 wherein is provided rotary coupling means in said piping means and located to permit the boom and thereby the conduit means to be swung in an arc relative to the tower without decoupling of the conduit means and the piping means.

6. In a method of building a circular concrete structure using an annular form system into which concrete mix is poured as successive annuluses and the system is periodically raised in height comprising the steps of:

locating the annular form system in disposition for receipt of concrete mix in the open upper part thereof;

establishing an upright flow path of height related to the elevation of the form system and extending along a line in the central area of said form system;

providing a normally elevated essentially lateral flow path for the concrete mix and connected to the upright flow path;

supporting the lateral flow path from a level above the same and in a manner such that the lateral path is maintained in a vertically inclined disposition with the extremity thereof proximal to the upright flow path lower than the opposite outboard extremity of the lateral flow path, said lateral flow path being of sufficient length to allow concrete mix flowing therealong to readily be directed into an adjacent area of the form system;

delivering concrete mix to the upright flow path on a substantially continuous basis for flow to the lateral path and thereafter to the form system;

diverting concrete mix from the outboard end of the lateral flow path into the annular form system; and maneuvering the support for the lateral flow path while maintaining the inclination of the latter relative to the horizontal through a first arc in one angular direction without changing the horizontal position of the upright flow path, of sufficient magnitude to allow diversion of concrete mix from said lateral path into at least approximately one-half of the circumferential extent of the annular form system and thence through a second arc in the opposite angular direction of sufficient extent to permit diversion of concrete mix from said lateral flow path into the remaining circumference of the annular form system and again without change in horizontal disposition of the upright flow path, said lateral flow path being pivoted about an upright axis therethrough during swinging of the support therefor in opposite directions as necessary to ensure that concrete mix is directed into the form system throughout the entire circumferential extent thereof without interruption in supply of the mix.

7. A method as set forth in claim 6 wherein is included the step of increasing the outboard elevation of the lateral flow path and thereby the angle of inclination of the same after concrete mix has been poured into the form system throughout the annular extent thereof, said angle of inclination of the lateral flow path being increased to an extent that another layer of concrete mix may be poured in the form system without increasing the effective height of the upright flow path.

8. A method as set forth in claim 6 wherein is included the step of lowering the lateral flow path to ground level through the central part of the form system and any annular concrete structure therebelow upon conclusion of a selected concrete mix pouring time period to facilitate clearing of concrete mix from the lateral flow path.

9. A method as set forth in claim 8 wherein is included the steps of releasably suspending the lateral flow path from the support therefor allowing such support to be used for other hoisting purposes.

* * * * *